US005098593A

United States Patent [19]

Rowe

[11] Patent Number: 5,098,593

[45] Date of Patent: Mar. 24, 1992

[54] MIXTURES OF PERCHLOROETHYLENE AND MONOCHLOROTOLUENE

[75] Inventor: Edward A. Rowe, Grand Island, N.Y.

[73] Assignee: Occidental Chemical Corporation, Niagara Falls, N.Y.

[21] Appl. No.: 623,640

[22] Filed: Dec. 7, 1990

[51] Int. Cl.[5] ..... C11D 7/22; C11D 7/50; B08B 7/00

[52] U.S. Cl. ..... 252/162; 252/153; 252/170; 252/171; 252/DIG. 8; 134/38; 134/39; 134/40

[58] Field of Search ..... 252/153, 162, 170, 171, 252/DIG. 8; 134/38, 39, 40

[56] References Cited

U.S. PATENT DOCUMENTS

| | | | |
|---|---|---|---|
| 3,925,008 | 12/1975 | Makino et al. | 252/99 |
| 3,974,310 | 8/1976 | Mischutin | 252/608 |
| 4,056,403 | 11/1977 | Cramer et al. | 252/162 |
| 4,120,798 | 10/1978 | Mischutin | 252/608 |
| 4,135,028 | 1/1979 | Hiestand et al. | 252/609 |
| 4,158,077 | 6/1979 | Mischutin | 252/608 |
| 4,348,306 | 9/1982 | Mischutin | 252/609 |
| 4,453,983 | 6/1984 | Berkeley | 252/143 |
| 4,498,933 | 2/1985 | Berkeley | 252/143 |
| 4,578,209 | 3/1986 | Hisamoto et al. | 252/170 |

*Primary Examiner*—A. Lionel Clingman
*Assistant Examiner*—William S. Parks
*Attorney, Agent, or Firm*—James F. Tao; Richard D. Fuerle

[57] ABSTRACT

Disclosed is a composition of about 25 to about 85 wt % perchloroethylene and about 15 to about 75 wt % monochlorotoluene. When the composition contains at least about 30 wt % perchloroethylene it does not display a flash point.

11 Claims, 1 Drawing Sheet

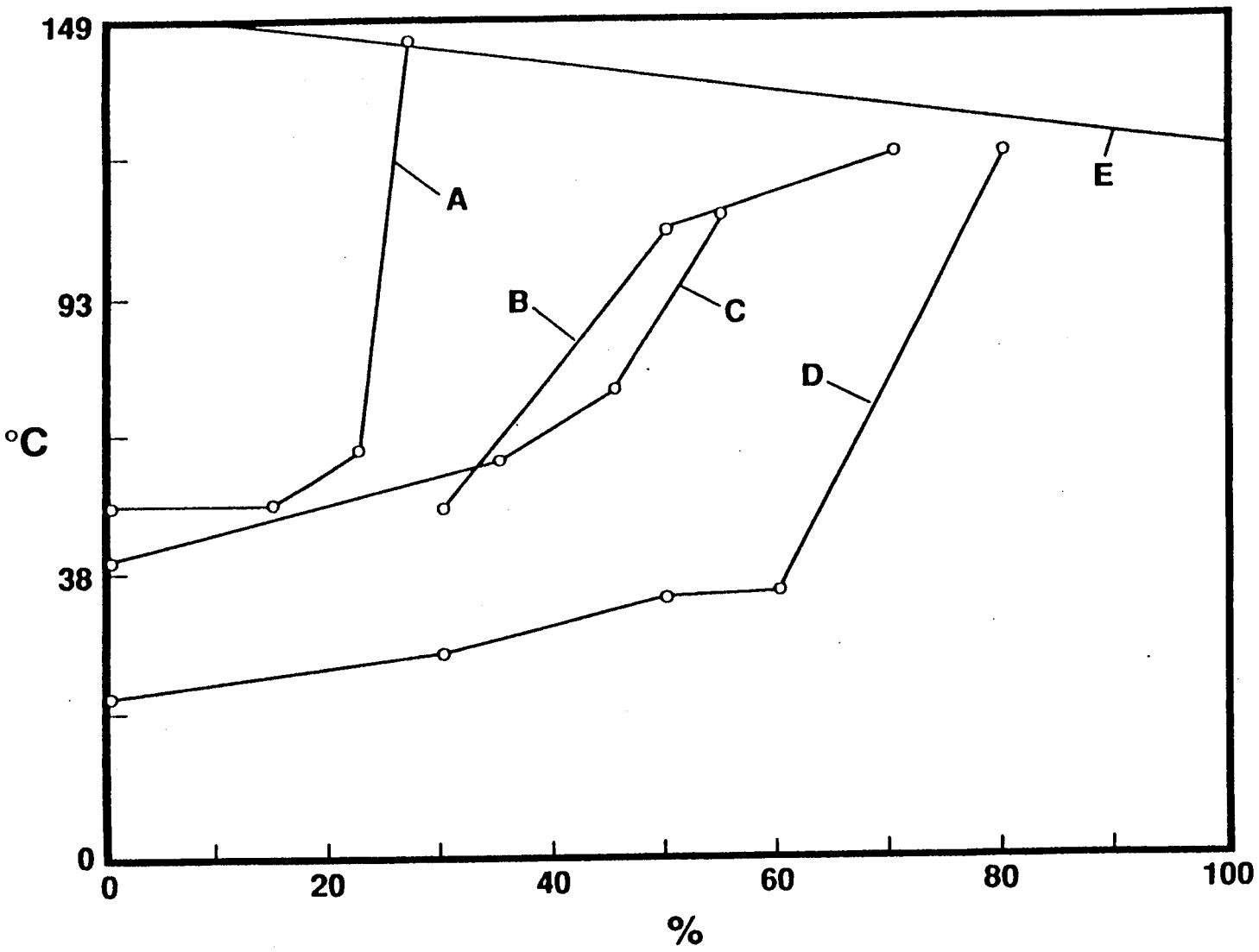
149
93
38
0
°C
0
20
40
60
80
100
%
A
B
C
D
E

MIXTURES OF PERCHLOROETHYLENE AND MONOCHLOROTOLUENE

BACKGROUND OF THE INVENTION

This invention relates to non-flammable mixtures of perchloroethylene and monochlorotoluene. In particular, it relates to mixtures of about 25 to about 85 wt % perchloroethylene with about 15 to about 75 wt % monochlorotoluene.

The solvent 1,1,1-trichloroethane is used in a variety of industrial applications because it is a good solvent for many organic compounds and it lacks a flash point under normal conditions of use, thereby providing a margin of fire safety to workers. While it is believed to be of low toxicity and non-carcinogenic, it has recently been implicated in the destruction of stratospheric ozone. As a result, its use will probably be phased out over the next decade and it is likely to be banned entirely early in the 21st century.

Industrial chemists and engineers are currently expending considerable funds and manpower to find a solvent that can replace 1,1,1-trichloroethane. Such a solvent would have to retain 1,1,1-trichloroethane's desirable properties, such as the absence of a flash point, the ability to dissolve a wide variety of organic compounds, and low toxicity and carcinogenicity, but would not have a deleterious effect on stratospheric ozone.

SUMMARY OF THE INVENTION

I have discovered that certain mixtures of perchloroethylene with monochlorotoluene do not have a flash point (i.e., the mixture boils before it ignites). This is surprising because mixtures of perchloroethylene with other aliphatic and aromatic compounds do have a flash point. Moreover, it is also surprising that the absence of a flash point in a perchloroethylene-monochlorotoluene mixture occurs when the perchloroethylene concentration in the mixture is only about 30 wt %.

Because orthochlorotoluene is a very good solvent, mixtures of perchloroethylene with orthochlorotoluene and monochlorotoluene have good solvency properties that are comparable to the solvency properties of 1,1,1-trichloroethane. In addition, the mixture of perchloroethylene and monochlorotoluene is of low toxicity and is not known, at the present time, to be carcinogenic, and neither perchloroethylene nor monochlorotoluene has been identified as a compound that destroys ozone.

I have further discovered that mixtures of perchloroethylene and monochlorotoluene display another unusual and unexpected property in that the mixtures freeze at a significantly lower temperature than does either perchloroethylene or monochlorotoluene. While mixtures of various organic solvents sometimes freeze at a lower temperature than either solvent in the mixture, the depression in the freezing point of mixtures of perchloroethylene with monochlorotoluene is significantly lower than the depression in the freezing point of mixtures of some similar organic solvents.

DESCRIPTION OF THE INVENTION

The accompanying drawing is a graph comparing the flammability of mixtures of perchloroethylene with various other solvents at different temperatures and in different proportions. The drawing is further explained in Example 1.

The compositions of this invention can be formed by mixing about 25 to about 85 wt % perchloroethylene with about 15 to about 75 wt % monochlorotoluene. If the composition contains less than about 25 wt % perchloroethylene, it will have a flash point below its boiling point and will be combustible, and if more than about 85 wt % of the composition is perchloroethylene, it will not be as good a solvent. The preferred range, for the best properties, is about 30 to about 75 wt % perchloroethylene and about 25 to about 70 wt % monochlorotoluene. If the composition is to be used in a closed container or the perchloroethylene that evaporates from the composition is captured and returned to the composition, the composition preferably is about 30 to about 40 wt % perchloroethylene and about 60 to about 70 wt % monochlorotoluene, in order to maximize its solvency properties while retaining its non-flammability. However, if the perchloroethylene is permitted to evaporate from the composition and is not returned to it, the composition is preferably about 70 to about 85 wt % perchloroethylene and about 15 to about 30 wt % monochlorotoluene so that sufficient perchloroethylene is always present in the evaporating composition to prevent it from igniting below its boiling point.

Perchloroethylene, $Cl_2C{=}CCl_2$, is also known as tetrachloroethene. Monochlorotoluene has the formula

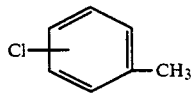

While the chlorine group may be in either the ortho, meta, or para positions, or mixtures of these positions, it is preferable to use orthochlorotoluene (o-chlorotoluene), parachlorotoluene (p-chlorotoluene), or mixtures thereof as those solvents are currently being manufactured in large amounts. For example, a 50/50 wt % mixture of ortho and para chlorotoluene is sold by Occidental Chemical Corporation under the trade designation "AG 125" and a mixture of 97 to 9 wt % o-chlorotoluene and 1 to 3 wt % p-chlorotoluene is sold by Occidental Chemical Corporation under the trademark "Halso 99."

In order to alter the properties of the mixture, it may be desirable to add other components to it. For example, the perchloroethylene-monochlorotoluene mixture can be mixed with about 1 to about 50 wt % (based on the weight of the perchloroethylene-monochlorotoluene mixture) of methylene chloride or trichloroethylene. The presence of methylene chloride is useful in increasing the evaporation rate of the mixture for applications such as adhesives. The presence of trichloroethylene increases the solvency of the composition and enables it to dissolve additional organic compounds or a higher percentage of an organic compound.

The following examples further illustrate this invention.

EXAMPLE 1

Perchloroethylene was mixed with various other solvents and the mixtures were tested for flash point using ASTM test D-5687, known as the Tag Closed Tester. The results of these tests are shown on the accompanying drawing. The ordinate gives the temperature of the mixture when it flashed and the abscissa gives the volume% of perchloroethylene in the mixture. Curve A is a mixture with Halso 99 monochlorotoluene, curve B is a mixture with a high-boiling (360° C.) hydrocarbon blend sold by Shell Oil Company as "Shell 360," curve C is a mixture with a petroleum distillate (ASTM D-484-52) known as "Stoddard Solvent," and curve D is "VM & P Naphthas", (varnish makers and painters), a partly refined or unrefined petroleum product. Curve E is the approximate boiling point of the mixtures. The drawing shows that only mixtures of perchloroethylene and monochlorotoluene had a flash point above the boiling point, which means that that mixture did not have a flash point. The drawing also shows that only about 22.4 to about 26.6 volume % (about 30 to about 35 wt %) of perchloroethylene was required in the mixture with monochlorotoluene to produce a mixture that did not have a flash point. Similar results were obtained using ASTM test D92-85, known as the Cleveland Open Cup test.

EXAMPLE 2

The freezing points of perchloroethylene, Halso 99 monochlorotoluene, and mixtures thereof are given in the following table:

| Composition (wt %) | | | Freezing Point |
|---|---|---|---|
| Perchloroethylene | Halso 99 | Halso 125 | (°C.) |
| 100 | 0 | 0 | −22 |
| 0 | 100 | 0 | −40 |
| 35 | 0 | 65 | −32 to −57 |
| 35 | 65 | 0 | −59 to −62 |
| 0 | 0 | 100 | −24.5 |

The table shows that the freezing point of the mixture was depressed by an unusually large amount.

I claim:

1. A mixture of tetrachloroethylene and monochlorotoluene that does not have a flash point comprising about 25 to about 85 wt % perchloroethylene and about 15 to about 75 wt % monochlorotoluene.

2. A composition according to claim 1 of about 30 to about 75 wt % perchloroethylene and about 25 to about 70 wt % monochlorotoluene.

3. A composition according to claim 2 of about 30 to about 35 wt % perchloroethylene and about 65 to about 70 wt % monochlorotoluene.

4. A composition according to claim 1 wherein said monochlorotoluene is o-chlorotoluene.

5. A composition according to claim 1 wherein said monochlorotoluene is p-chlorotoluene.

6. A composition according to claim 1 wherein said monochlorotoluene is a mixture of about 97 to about 99 wt % o-chlorotoluene and about 1 to about 3 wt % p-chlorotoluene.

7. A composition according to claim 1 wherein said monochlorotoluene is a mixture of about 50 wt % o-chlorotoluene and about 50 wt % p-chlorotoluene.

8. A composition according to claim 1 which includes about 1 to about 50 wt % methylene chloride, based on the weight of perchloroethylene plus monochlorotoluene.

9. A composition according to claim 1 which includes about 1 to about 50 wt % trichloroethylene, based on the weight of perchloroethylene plus monochlorotoluene.

10. A composition according to claim 1 of about 30 to about 40 wt % perchloroethylene and about 60 to about 70 wt % monochlorotoluene.

11. A composition according to claim 1 of about 70 to about 85 wt % perchloroethylene and about 15 to about 30 wt % monochlorotoluene.

* * * * *